United States Patent [19]

Mitchell

[11] Patent Number: 4,718,246

[45] Date of Patent: Jan. 12, 1988

[54] PRESSURE CONTROL OVERRIDE

[76] Inventor: Charles F. Mitchell, 133 Carlin Dr., Carmel, Ind. 46032

[21] Appl. No.: 902,588

[22] Filed: Sep. 2, 1986

[51] Int. Cl.[4] ..... F25B 41/00

[52] U.S. Cl. ..... 62/208; 62/215; 62/228.3

[58] Field of Search ..... 62/228.3, 228.1, 208, 62/215

[56] References Cited

U.S. PATENT DOCUMENTS

| | | | |
|---|---|---|---|
| 2,191,965 | 2/1940 | McGrath | 62/208 |
| 2,191,967 | 2/1940 | Miller . | |
| 2,296,534 | 9/1942 | Newton | 62/228.3 X |
| 3,171,264 | 3/1965 | Griffin . | |
| 3,498,075 | 3/1970 | Zumbiel | 62/228.3 X |
| 3,791,161 | 2/1974 | Kramer | 62/228.3 X |

*Primary Examiner*—William E. Tapolcai
*Attorney, Agent, or Firm*—Barnes & Thornburg

[57] ABSTRACT

A pressure control override apparatus for overriding a conventional pressure control starting switch on a refrigeration system is provided. The apparatus includes a power supply that receives power only when the valve in the liquid line of the refrigeration system is open. The apparatus also includes a temperature sensor for sensing the ambient temperature in the area of the compressor and condenser. The apparatus further includes a circuit to start the compressor that is separate from the normal pressure control starting switch when the apparatus is energized and the ambient temperature sensed by the temperature sensor is lower than a preselected temperature.

5 Claims, 2 Drawing Figures

PRESSURE CONTROL OVERRIDE

BACKGROUND OF THE INVENTION

The present invention relates to refrigeration control devices. More particularly, the present invention relates to a device for overriding the pressure control starting switch for a compressor on a conventional refrigeration system having a pump-down cycle when the compressor is subjected to low ambient temperatures.

Generally, medium temperature refrigeration units have been one of two types. A first type, and generally considered outdated now, utilizes a compressor and condenser located generally either inside a building, or in the basement of a building. Thus, the compressor and condenser unit in this first type of system is never subjected to near 0° F. temperatures which can cause the refrigerant, normally Freon 12, to change to a liquid state when the system is shut off.

A second type of system, and that normally in use today, utilizes, a compressor and condenser unit that is placed outside the building, and normally either mounted on the roof of the building, or at the side of the building. Therefore, the compressor and condenser unit on a new type of system is periodically exposed to ambient temperatures well below 32° F., and in some portions of the country, below 0° F. Because of this exposure to low ambient temperatures, the new type systems are configured to include a pump-down cycle to prevent the compressor pump from being damaged.

A pump-down cycle is accomplished by installing a solenoid valve in the liquid line of the refrigeration system. When the temperature inside the refrigerated area is satisfied, the thermostat in the refrigerated area interrupts the power to the solenoid valve, and the solenoid valve closes off the liquid line. The compressor continues to run until all of the refrigerant is captured inside a receiver tank that is generally located with the compressor on the condensing unit. When the liquid has been captured in the receiving unit, the compressor is then shut off. The shut-off of the compressor is controlled by a pressure control device that may be set to shut off the compressor at a preselected pressure. The pressure control is normally set to shut off the compressor when the pressure in the suction line of the system reaches 0 pounds per square inch gauge (psig). When the temperature inside the refrigerated space rises to a preselected level, the thermostat in the space returns the power to the solenoid valve which opens the liquid line. Normally, the refrigerant pressure rises in the system to a pre-set level on the pressure control, and the compressor begins to operate and cool the space again.

The pump-down cycle is necessary because in cold ambient conditions, in a system without a pump-down cycle, the refrigerant will migrate to the coldest point in the system when the compressor is shut off. Where the compressor and condenser are located outside, the coldest point will normally be these units. If the ambient temperature is low enough, this migrated refrigerant will quickly liquify. Upon starting the compressor pump again, the pump will be forced to pump this liquid refrigerant. This action quickly damages compressor pumps because such pumps are not designed to pump any liquids at all, only to pump and compress gases. The pump-down cycle prevents damage to the compressor pump by forcing all of the refrigerant in the system to the receiver tank, which is separated from the compressor pump. Thus, in a system with a pump-down cycle, when the compressor pump is turned on again, the pump will not be forced to pump the liquid refrigerant.

One problem with the new type of systems equipped with a pump-down cycle is that in very cold ambient conditions, the pressure of the refrigerant may not be able to rise to the necessary pressure required to activate the pressure control after the solenoid valve is opened. This condition will prevent the compressor pump from starting, and therefore will prevent the refrigeration system from continued cooling of the refrigerated space, because in a pump-down system, the pressure control is the only control that starts and stops the compressor. Normally, when this condition occurs, a serviceman must be called to start the compressor.

The serviceman can generally start the compressor by one of two methods. First, the serviceman can set the pressure control to turn on at a very low pressure, for example at 0 psig. This method has the disadvantage of causing the compressor to run much longer than necessary, and particularly causes the system to operate in a vacuum much of the time. Operating the system in a vacuum is highly undesirable because contaminants can be drawn into the system which can cause system breakdown and system replacement. The second method that may be used by the serviceman is to install a jumper wire across the pressure control. This method has a disadvantage of causing the compressor to run continuously. This method also has the disadvantage of causing the compressor to run much longer than normal, and causing the system to operate in the vacuum much of the time.

Because of these problems with the new type of systems in low ambient temperature conditions, it would be advantageous to have a device that could bypass the pressure control and start the compressor motor under these conditions. One type of bypass device for bypassing the pressure control of a refrigeration system is disclosed in U.S. Pat. No. 2,191,965 to McGrath. However, the device disclosed in McGrath is usable only on the first type, or older type, of refrigeration systems without a pump-down cycle. McGrath discloses a system in which either the thermostat 20 or the low pressure control 21 can regulate the temperature of the space to be cooled. The respective settings on these two controls determine which of the controls will regulate the temperature inside the refrigerated space. McGrath discloses that the use of two controls to start the compressor is to insure that the evaporator is adequately defrosted during each off cycle of the system.

In the McGrath device, when the refrigerated space temperature rises to a preselected level, the compressor does not immediately turn on. Instead, the low pressure control 21 causes the starting of the compressor to be delayed until the refrigerant pressure reaches 30 psig. Forcing the compressor to delay starting until the refrigerant pressure reaches 30 psig insures that the evaporator is adequately defrosted before the compressor starts. Because the old type of refrigeration systems sometimes located the compressor and condenser units in the basement of the buildings, it was possible for the basement temperature to sometimes fall below about 30° F. If the temperature fell below 30° F., the refrigerant pressure sometimes would not reach the required 30 psig to cause the low pressure control 21 to start the compressor. To insure that the compressor would start under these conditions, McGrath discloses a low ambient temperature control 22 that bridges across the low pressure control 21 whenever the ambient temperature is below 30° F. In McGrath's device, the low pressure control 21 is continuously bridged as long as the temperature remains below 30° F. Thus, the thermostat 20 becomes the sole control for starting and stopping the compressor, and therefore the defrost period for the system is bypassed.

It is apparent from the above discussion that the device disclosed in McGrath could not possibly be used on a new type refrigeration system having a pump-down cycle. If the McGrath device were so installed, whenever the ambient temperature was below 30° F., the compressor would be forced to run continuously because on a pump-down system, the low pressure control is the only control that starts or stops the compressor. Because it is undesirable to run the compressor continuously, the McGrath device would not solve the problems related to low ambient conditions on a new type refrigeration system.

It is therefore one object of the present invention to provide a pressure control override apparatus that is usable on a refrigeration system having a pump-down cycle, and in which the pressure control is the only control that starts and stops the compressor.

It is another object of the present invention to provide a pressure control override apparatus that is activated only when both the ambient temperature around the compressor and condenser units is below a preselected level, and when the refrigerated space temperature rises to a preselected level indicating that cooling within the space is required.

SUMMARY OF THE INVENTION

According to the present invention, a pressure control override apparatus is provided for overriding a conventional pressure control starting switch on a refrigeration system that includes a compressor having a pump-down cycle and a refrigerated space to be cooled. The apparatus includes means for selectively energizing the apparatus sensitive to the temperature in the refrigerated space when the temperature rises to a selected level. The apparatus further includes means for sensing the ambient temperature in the area of the compressor, and the means for starting the compressor separate from the normal pressure control starting switch when the apparatus is energized and the ambient temperature is less than a predetermined temperature.

One feature of the foregoing structure is that the pressure control override apparatus is not energized until the temperature within the refrigerated space reaches a selected level. One advantage of this feature is that the apparatus is energized only during the period of time that the compressor should be running. This selective energizing of the apparatus permits the compressor to function normally during the pump-down cycle, and to shut off normally when the pressure in the system reaches the normal shut off pressure.

In preferred embodiments of the present invention, the starting means includes a relay circuit that is closed only when both the apparatus is energized, and the sensing means senses an ambient temperature that is lower than a predetermined level. One advantage of this feature is that the apparatus does not interact with the compressor to start the compressor until both conditions are met. This permits the refrigeration system to function normally at all other times.

Applicant's invention provides an apparatus that solves the problems with conventional refrigeration systems having pump-down cycles with the compressors and condensers located in areas where they are exposed to low ambient temperature conditions. Applicant's invention is only activated during the period of time that the compressor would normally be running, and is deactivated both during the pump-down cycle, and at all times while the compressor is shut off. Applicant's invention solves the problems associated with such systems, without resorting to the measures now normally taken to overcome this problem.

DETAILED DESCRIPTION OF THE DRAWINGS

Figure 1:
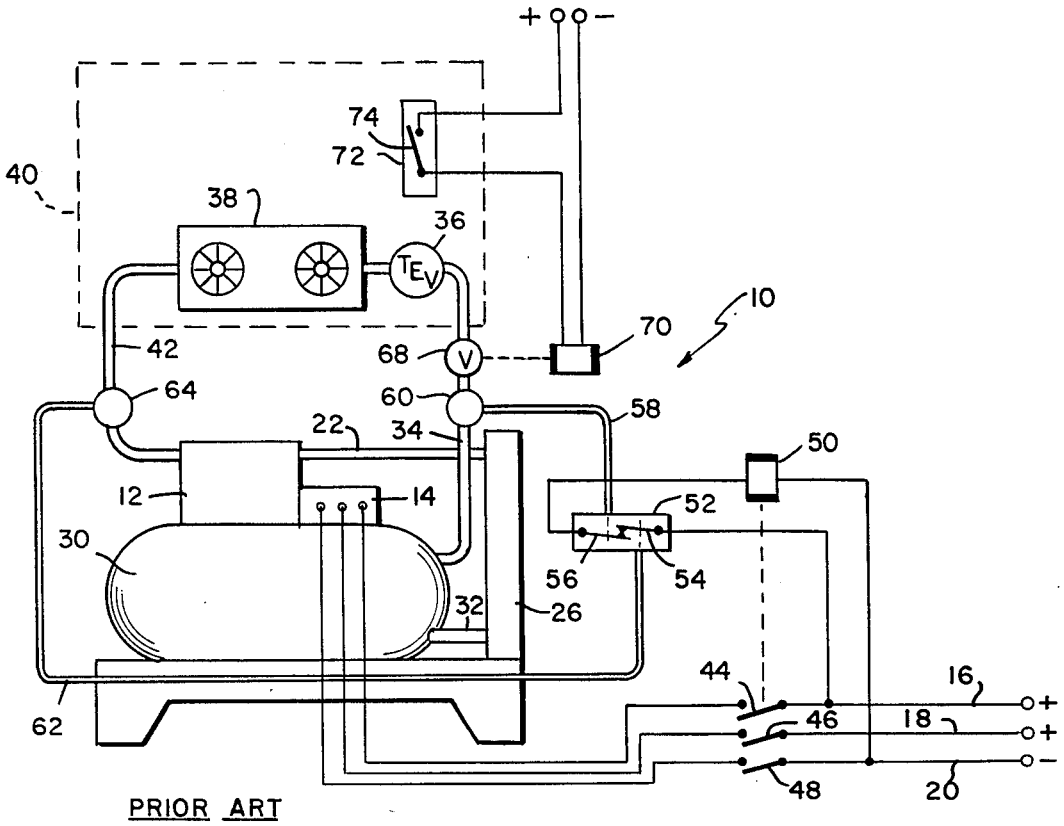
PRIOR ART FIG. 1
FIG. 1 is a diagrammatic view of a medium temperature refrigeration system equipped with a pump-down cycle.

Referring now to FIG. 1, FIG. 1 shows a prior art, conventional medium temperature refrigeration system equipped with a pump-down cycle. Normally, this type of system 10 is used to cool a large refrigerated space, typically a walk-in type cooler. Such walk-in type coolers are typically installed in supermarkets, convenience markets, and the like. The system 10 includes a compressor 12 that compresses a refrigerant gas, illustratively Freon 12. An electric motor 14 is provided to drive the compressor 12. Illustratively, the electric motor 14 is a 3-phase, 240 volt motor that is connected to a 240 volt, 3-phase power supply (not shown) by wires 16, 18, and 20.

The output of the compressor 12 is connected by a connecting tube 22 to a condenser 26. The condenser 26 operates in a customary manner to remove heat from the compressed refrigerant at a constant pressure until the refrigerant becomes a saturated liquid. The liquid refrigerant passes from the condenser 26 to a receiver 30 through a connecting tube 32. The liquid refrigerant then passes from the receiver 30 through a liquid line 34 to a thermal expansion valve 36. As the liquid refrigerant passes through the thermal expansion valve 36, it is expanded adiabatically, which reduces the pressure of the refrigerant. Thus, the refrigerant exits the expansion valve 36 as a highly cooled gas. The cooled gas refrigerant then passes through an evaporator 38 where air-cooling occurs. The evaporator 38 is shown installed in a cooler 40 (shown only in dotted line). Illustratively, the cooler 40 is a walk-in type cooler used to store perishable items at a refrigerated temperature, normally slightly above freezing.

After the refrigerant passes through the evaporator 38, its pressure is lowered considerably. This low pressure refrigerant is then routed by a suction line 42 to the intake side of the compressor 12. The low pressure refrigerant is then compressed by the compressor 12 to begin the above-described cycle. Thus, the system 10 is a conventional, closed system that operates to cool the cooler 40.

As stated previously, the compressor motor 14 is powered by a 240 volt power supply (not shown) through wires 16, 18, and 20. Contacts 44, 46, and 48 are provided in the wires 16, 18, and 20, respectively, to control the power to the motor 14. It will be understood that the contacts 44, 46, and 48 collectively function to start and stop the motor 14. The contacts 44, 46, and 48 are controlled by a contactor coil 50 that operates in a conventional manner to open and close the contacts 44, 46, and 48 simultaneously. One terminal of the contactor coil 50 is connected directly to the power wire 20 of the 240 volt power supply. The other terminal of the contactor coil 50 is connected to the power wire 16 of the 240 volt power supply through a dual-pressure control 52.

The dual-pressure 52 includes a low pressure contact 54 and a high pressure contact 56 that are capable of individually interrupting the power to the contactor coil 50. The high pressure contact 56 is coupled by a capillary tube 58 to a high pressure sensor 60 that is installed in the liquid line 34. The high pressure contact 56 is normally closed, and opens only when the high pressure sensor 60 is subjected to a pressure that exceeds a predetermined, excessive level. It will be understood that in normal operation, the high pressure contact 56 will be closed. The low pressure contact 54 is coupled through a capillary tube 62 to a low pressure sensor 64 that is installed in the suction line 42. The low pressure contact 54 is configured to open when the pressure in the suction line 42 drops to a preselected, low pressure. Illustratively, the low pressure contact 54 is configured to open when the pressure in the suction line 42 reaches 0 psig. The low pressure contact 54 is also configured to close when the pressure in the suction line 42 increases to a preselected level, illustratively 6–7 psig.

Thus, in normal operation, the high pressure contact 56 and the low pressure contact 54 will be closed to provide power to the contactor coil 50 when the pressure in the suction line 42 is above 6–7 psig, and the pressure in the liquid line 34 does not exceed the predetermined, excessive pressure level. When power is supplied to the contactor coil 50, the contacts 44, 46, and 48 will be closed, providing power to the motor 14 to drive the compressor 12. When the pressure in the suction line 42 drops to approximately 0 psig, the low pressure contact 54 will open to interrupt the power to the contactor coil 50. When power is interrupted to the contactor coil 50, the contacts 44, 46, and 48 open, interrupting power to the motor 14. When the pressure in the suction line 42 increases to above 6–7 psig, the low pressure contact 54 closes, providing power to the contactor coil 50 to again close the contacts 44, 46, and 48.

The system 10 is configured to include a conventional pump-down cycle. In a pump-down cycle, the flow of liquid refrigerant from the condenser 26 to the evaporator 38 is interrupted, while the compressor 12 continues to operate. The operating compressor 26 will draw all of the refrigerant from the evaporator 38 through the suction line 42 into the receiver 30. The refrigerant is then stored in the receiver 30, away from the compressor 12. When the refrigerant liquifies due to the cold temperatures, it will then be separate from the compressor 12.

To provide the pump-down cycle, a valve 68 is installed in the liquid line 34 between the condenser 26 and the expansion valve 36. The valve 68 is controlled by a conventional solenoid coil 70 that opens and closes the valve 68 selectively. One terminal of the solenoid coil 70 is connected directly to one terminal of a power supply, illustratively a 120 volt power supply (not shown). The other terminal of the solenoid coil 70 is connected to the other terminal of the power supply (not shown) through a thermostat 72 which includes a switch 74.

The thermostat 72 is installed within the cooler 40, and operates in a conventional manner to interrupt the power to the solenoid coil 70 whenever the temperature within the cooler 40 drops below a preselected temperature. It will be understood that this preselected temperature is the desired temperature to be maintained within the cooler 40. Whenever the temperature within the cooler 40 drops below the preselected temperature, power to the solenoid coil 70 is interrupted, closing the valve 68. Whenever the temperature within the cooler 40 increases above this preselected temperature, the switch 74 closes to provide power to the solenoid coil 70, which then opens the valve 68. It will be understood that when the valve 68 is open, the liquid refrigerant is allowed to pass through the evaporator 38 to cool the cooler 40. When the valve 68 is closed, liquid refrigerant is prevented from passing through the evaporator 38, and no cooling in the cooler 40 occurs.

Thus, it will be understood that the thermostat 72 acts as the sole control to directly govern and regulate the flow of refrigerant through the evaporator 38. The thermostat 72 also acts as the sole control to indirectly start and stop the compressor 12. Whenever the valve 68 is closed by the thermostat 72, the compressor 12 runs until the pressure in the suction line 42 drops to 0 psig. At that time, the low pressure contact 54 opens to shut off the compressor 12. The compressor 12 will remain off until the valve 68 is opened by the thermostat 72. When the valve 68 is opened, the pressure of the refrigerant normally increases within the suction line 42 above the 6–7 psig, required and the low pressure contact 54 closes to again start the compressor 12.

One major problem that occurs in refrigeration systems similar to system 10 is that, when the compressor 12 and condenser 26 are exposed to very cold ambient temperatures, the refrigerant pressure may not increase to the required 6–7 psig after the valve 68 is opened by the thermostat 72. When this occurs, the compressor 12 does not start, and no refrigerant is circulated through the evaporator 38 to cool the cooler 40. Thus, the temperature within the cooler 40 continues to increase which, if left unchecked, can spoil the goods in the cooler 40. Normally, when this condition occurs, a serviceman must be called to start the compressor 12.

Typically, the serviceman will perform one of two steps to start the compressor 12. First, the serviceman may simply jump around the dual-pressure control 52 so that power is continuously supplied to the contactor coil 50. This causes the compressor 12 to run continuously. Because the thermostat 72 and valve 68 are unaffected, the valve 68 will open and close normally under the direction of the thermostat 72. Whenever the valve 68 is closed, and the compressor 12 is forced to run continuously, the system 10 will operate in a vacuum much of the time. When operating in a vacuum, the system 10 is susceptible to drawing contaminants into the refrigerant, with possible damage occurring to the compressor 12 and other components of the system 10.

A second alternative for the serviceman to start the compressor 12 is to readjust the low pressure sensor 64 so that the low pressure contact 54 will close when the pressure within the suction line increases to only around 0 psig. This alternative also forces the system 10 to operate in a vacuum much of the time because the low pressure contact 54 will not open to shut off the compressor until the pressure within the suction line 42 falls to well below 0 psig. Thus, both alternatives conventionally available to a serviceman have highly undesirable affects on the system 10.

Figure 2:
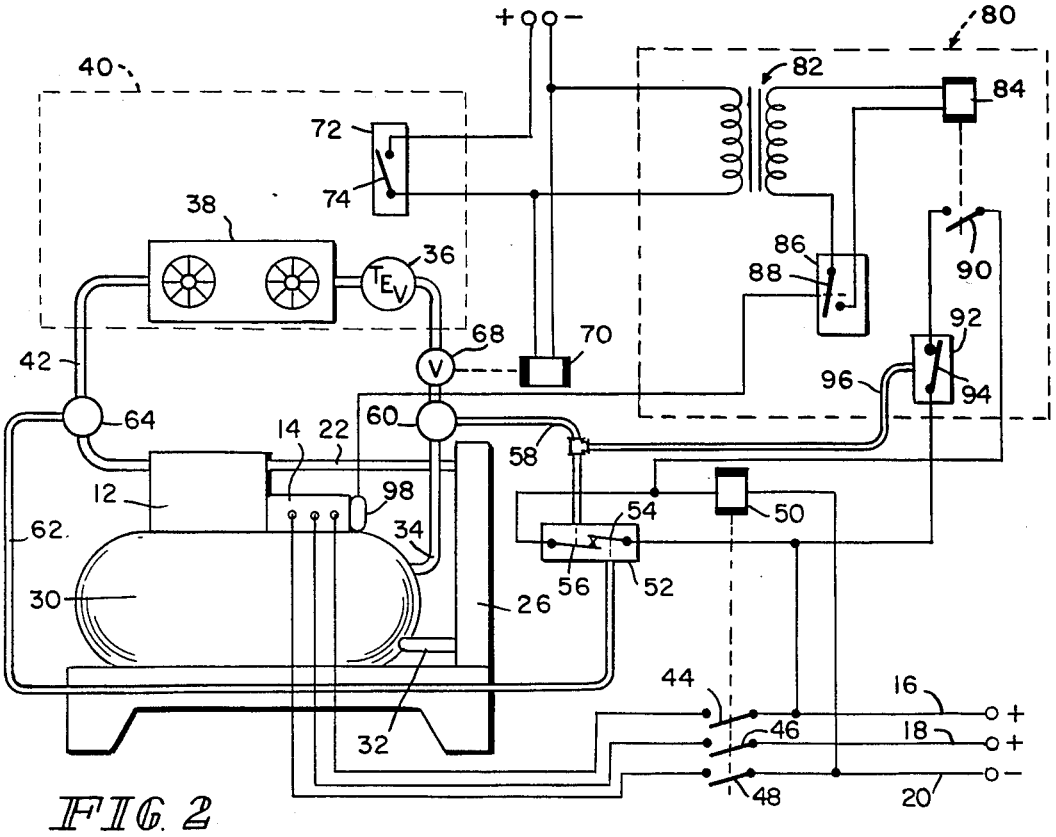
FIG. 2 is a diagrammatic view showing the override device of the present invention adapted to the refrigeration system of FIG. 1.

Referring now to FIG. 2, FIG. 2 shows a pressure control override apparatus 80 of the present invention adapted to the system 10 of FIG. 1. The override apparatus 80 includes a step-down power transformer 82 that provides power to the device 80 selectively. One terminal of the input side of the transformer 82 is connected directly to one terminal of the 120 volt power source (not shown) that provides power to the solenoid coil 70. The other terminal of the input side of the transformer 82 is connected to the other terminal of the 120 volt power supply between the thermostat 72 and the solenoid coil 70. Thus, whenever the switch 74 of the thermostat 72 is closed, and the solenoid coil 70 is receiving power, the input side of the transformer 82 will also receive power. Illustratively, the transformer 82 reduces the 120 volt input voltage to 24 volts to increase the safety of the apparatus 80. It will be understood that a different input voltage could be used, as well as a different output voltage of the transformer, without affecting the function of the apparatus 80.

One terminal of the output side of the transformer 82 is connected to one terminal of a relay coil 84. The other terminal of the output side of the transformer 82 is connected through a thermostat 86 to the other terminal of the relay coil 84. The thermostat 86 includes a switch 88 that opens and closes in response to a temperature sensor 98 that is mounted adjacent the compressor 12. The switch 88 is configured to close whenever the temperature sensor 98 is subjected to a temperature lower than a preselected temperature, illustratively below 30° F. The switch 88 is configured to open whenever the temperature sensor 98 is exposed to a temperature above this preselected temperature.

When the switch 88 is closed, the relay coil 84 will receive power from the transformer 82. When powered, the relay coil 84 will close a switch 90 in a circuit that bridges across the dual-pressure control 52. One terminal of the switch 90 is connected to one terminal of the contactor coil 50, between the dual-pressure 52 and the contactor coil 50. The other terminal of the switch 90 is connected through a high pressure relay 92 to the power wire 16 of the 240 volt power supply (not shown). The high pressure relay 92 includes a switch 94 that is normally closed, and only opens when the pressure sensed by the high pressure sensor 60 exceeds a predetermined excessive level. The high pressure relay 92 is coupled to the high pressure sensor 60 by a capillary tube 96. Typically, the switch 94 will open at the same predetermined excessive pressure level as the high pressure contact 56 in the dual-pressure control 52. Both of the switches 92, 56 are designed to interrupt the power to the compressor 12 when the refrigerant pressure within the system 10 reaches an excessive, dangerous level. Because the override apparatus 80 bypasses the contact 56 under certain conditions, the high pressure relay 92 and switch 94 are included within the override apparatus 80 to perform the function of the high pressure contact 56 during the periods of time that the high pressure contact 56 is overridden.

In operation, the transformer 82 receives power only when the switch 74 and a thermostat 72 are closed. It will be understood that this corresponds to the period of time that the valve 68 is open, and when the compressor 12 should be running. Assuming first that the compressor 12, and consequently the temperature sensor 98, are exposed to ambient temperatures below 30° F., the switch 88 will be closed. When the switch 74 in the thermostat 72 closes to provide power to the solenoid coil 70, the transformer 82 will receive power from the 120 volt power supply and convert this power to 24 volts. With the switch 88 closed, the relay coil 84 will receive power to close the switch 90. With the switch 90 closed, and assuming that the switch 94 is closed, the contactor coil 50 will receive power from a portion of a 240 volt power supply and the contacts 44, 46, and 48 will close to start the compressor 12. Because the ambient temperature around the compressor 12 is below 30° F., the compressor 12 would normally not start when the valve 68 was opened because the refrigerant pressure in the suction line 42 would not rise to the required 6–7 psig. Thus, the override apparatus 80 functions to start the compressor 12 immediately upon opening of the valve 68 under these conditions.

With the compressor 12 now running, the pressure within the suction line 42 will normally rise above the 6–7 psig required to close the low pressure contact 54. Thus, after a short period of running time of the compressor 12, the low pressure contact 54 will close. When the temperature within the cooler 40 decreases to the desired level, the thermostat 72 will interrupt the power to the solenoid coil 70 to close the valve 68. At this time, power to the transformer 82 will also be interrupted, and consequently the power to the relay coil 84 will be interrupted. This will cause the switch 90 to open to interrupt the override circuit. The compressor 12 will continue running, however, because the low pressure contact 54 is now closed.

Thus, the override apparatus 80 only operates to start the compressor 12, and as soon as the refrigerant pressure reaches the required 6–7 psig to close the low pressure contact 54, has no further function in the system 10. After the valve 68 is closed, the compressor 12 will continue to run during the pump-down cycle until refrigerant pressure reaches 0 psig, as described previously. Assuming that the ambient temperature around the compressor 12, and consequently around the temperature sensor 98, increases to above 30° F., the switch 88 in the thermostat 86 will open. In this configuration, when power is supplied to the solenoid coil 70 through the thermostat 72, the relay coil 84 will not receive power, and the override device 80 will be inactive. However, when the ambient temperature is above about 30° F., the compressor 12 is capable of starting normally without the aid of the override device 80.

Thus, the override apparatus 80 only functions to start the compressor 12 immediately upon opening of the valve 68 when the compressor 12 is incapable of starting on its own. Also, the override apparatus 80 functions only to start the compressor 12 under these conditions, and does not interfere with the operation of the compressor 12, or the system 10 in general, in any other manner.

Although the invention has been described in detail with reference to a preferred embodiment and specific examples, variations and modifications exist within the scope and spirit of the invention as described and defined in the following claims:

What is claimed is:

1. A pressure control override apparatus for overriding a conventional pressure control starting switch on a refrigeration system, the refrigeration system having a compressor with a pump-down cycle, an evaporator, a liquid line for conducting a compressed refrigerant between the compressor and the evaporator, and an electrically activated solenoid valve mounted in the liquid line for alternatively opening the liquid line when power is applied to the valve and a closing said liquid line when power is removed from the valve, the apparatus comprising:

a first circuit;

means for alternatively powering said first circuit when power is applied to the solenoid valve, and for removing power from said first circuit when power is removed from the solenoid valve;

an ambient temperature sensing switch in said first circuit and configured to sense the ambient temperature at a location substantially adjacent the compressor, the switch configured to close said first circuit when the ambient temperature falls below a preselected level, and to open said first circuit when the ambient temperature raises above said preselected level; and a second circuit configured to start said compressor separate from said pressure control starting switch when said second circuit is closed, including a relay switch in said second circuit configured to close said second circuit only when both said first circuit is closed and said first circuit is powered by said powering means, and a normally closed high pressure safety switch in said second circuit configured to open said second circuit when the pressure in said liquid line reaches a predetermined excessive level.

2. A pressure control override apparatus for starting the compressor of a refrigeration system having a pump-down cycle when the ambient temperature surrounding the compressor is below a preselected level, the refrigeration system including, an evaporator for cooling a designated space, a liquid line for conducting a compressed refrigerant from the compressor to the evaporator, and a temperature-controlled valve for alternatively opening and closing the liquid line, the apparatus comprising:

a first circuit that is configured to receive power only when said valve is open;

an ambient temperature controlled relay in said first circuit configured to close said first circuit only when said ambient temperature is below a predetermined level;

a second circuit adapted to start said compressor when said first circuit is closed and receiving power, and a normally closed high-pressure safety switch in said second circuit configured to open said second circuit to prevent said compressor from starting when the pressure in said liquid line reaches a predetermined excessive level.

3. An apparatus for use in combination with a refrigeration system for cooling a space, the refrigeration system comprising, a compressor for compressing and pumping a refrigerant, a receiver unit for receiving refrigerant from the compressor, an evaporator located in the space to be cooled, a first liquid line for conducting the refrigerant from the receiver to the evaporator, a thermostat for sensing temperature in the space, a flow control valve mounted in the first liquid line and responsive to the thermostat for controlling the flow of refrigerant from the receiver to the evaporator, the valve alternately opened in response to a temperature in the space greater than a first preselected level to permit the refrigerant to flow to the evaporator to cool the space, and closed in response to a temperature in the space less than a second preselected level to prevent the flow of refrigerant to the evaporator to stop cooling the space, a second liquid line for conducting the refrigerant from the evaporator to the compressor, and a pressure controlled switch for starting and stopping the compressor responsive to a pressure level of the refrigerant in the second liquid line, the switch connecting the compressor to a source of power to start the compressor when the refrigerant pressure increases to a first preselected level, and disconnecting the compressor from the source of power to stop the compressor when the refrigerant pressure decreases to a second preselected level below the first preselected level, the apparatus comprising, sensing means for sensing the ambient temperature in the area of the compressor, and switch means in parallel to the pressure controlled switch and responsive to the sensing means and the space thermostat for overriding the starting function of the pressure controlled switch to connect the compressor to the source of power to start the compressor only when the ambient temperature is less than a predetermined amount and only when the temperature in the space exceeds the first preselected temperature level, the switch means including a normally closed high pressure safety switch responsive to the refrigerant pressure in the first liquid line for opening the switch means when the refrigerant pressure exceeds a third preselected excessive level.

4. The apparatus of claim 3, wherein the switch means comprises, a circuit having a control switch, the circuit being situated in parallel to the pressure controlled switch, and a relay coil for controlling the control switch, the relay coil being responsive to the sensing means and to the space thermostat for closing the control switch to complete the circuit to connect the compressor to the source of power only when the ambient temperature is less than a predetermined amount and only when the temperature in the space exceeds the first preselected temperature level.

5. The apparatus of claim 4, wherein the switch means further comprises a power transformer that includes an input and an output, the input receiving power only when the temperature in the space exceeds the first preselected temperature level, the transformer output coupled to the relay coil through the sensing means power the relay coil to close the control switch only when the input is receiving power and only when the ambient temperature is less than the predetermined amount.

* * * * *